US008414113B2

(12) United States Patent
Kawase et al.

(10) Patent No.: US 8,414,113 B2
(45) Date of Patent: Apr. 9, 2013

(54) DISCHARGING DEVICE AND PRINTING APPARATUS

(75) Inventors: Junya Kawase, Yokohama (JP); Manabu Sueoka, Yokohama (JP); Shinji Yamamoto, Kawasaki (JP); Yohji Ara, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/677,698

(22) PCT Filed: Oct. 8, 2008

(86) PCT No.: PCT/JP2008/068687

§ 371 (c)(1),
(2), (4) Date: Mar. 11, 2010

(87) PCT Pub. No.: WO2009/054302

PCT Pub. Date: Apr. 30, 2009

(65) Prior Publication Data

US 2010/0201759 A1 Aug. 12, 2010

(30) Foreign Application Priority Data

Oct. 26, 2007 (JP) ..... 2007-278963

(51) Int. Cl.
*B41J 2/175* (2006.01)
*B41J 2/195* (2006.01)
*B41J 2/17* (2006.01)

(52) U.S. Cl.
USPC ..... 347/85; 347/7; 347/84

(58) Field of Classification Search ..... 347/7, 84, 347/85, 89
See application file for complete search history.

(56) References Cited

U.S. PATENT DOCUMENTS

| | | | |
|---|---|---|---|
| 5,347,713 | A | 9/1994 | Shibata et al. |
| 2009/0219334 | A1 | 9/2009 | Yamamoto |
| 2010/0289856 | A1 | 11/2010 | Yamamoto et al. |

FOREIGN PATENT DOCUMENTS

| | | | | |
|---|---|---|---|---|
| JP | 49-141481 | | | 12/1974 |
| JP | 55-157164 | | | 11/1980 |
| JP | 63-145039 | A | | 6/1988 |
| JP | 2000-15004 | A | | 1/2000 |
| JP | 2000-301737 | A | | 10/2000 |
| JP | 2003-291363 | A | | 10/2003 |
| JP | 2007-216535 | A | | 8/2007 |
| JP | 2008-030388 | A | | 2/2008 |
| JP | 2008030388 | A | * | 2/2008 |

OTHER PUBLICATIONS

Japanese Office Action dated Dec. 6, 2011, in corresponding Appln. No. 2007-278963.

* cited by examiner

*Primary Examiner* — Matthew Luu
*Assistant Examiner* — Jannelle M Lebron
(74) *Attorney, Agent, or Firm* — Fitzpatrick, Cella, Harper & Scinto

(57) ABSTRACT

A discharging device includes a liquid container configured to contain a liquid, a discharge channel configured to discharge a fluid from the liquid container, a float member which is lower in specific gravity than the liquid, is movably arranged in the discharge channel, and move up together with the liquid to come into contact with a float sealing member arranged in the discharge channel, thereby shutting the discharge channel, separating means configured to separate the float member from the float sealing member, suction means configured to discharge the fluid from the liquid container via the discharge channel, and control means configured to operate the separating means when operating the suction means.

13 Claims, 15 Drawing Sheets

DISCHARGING DEVICE AND PRINTING APPARATUS

TECHNICAL FIELD

The present invention relates to an inkjet printing apparatus and, more particularly, to an inkjet printing apparatus having an ink supply system for supplying ink to an inkjet printhead.

BACKGROUND ART

Inkjet printing apparatuses have been widely used and commercialized as a computer-related output device and the like because their running cost is low and they can be downsized and easily compatible with color image printing using a plurality of color inks.

As an energy generating element which generates energy for discharging ink from the orifices of a printhead, some printheads use an electromechanical transducer such as a piezoelectric element. Some printheads generate heat by emitting an electromagnetic wave from a laser or the like, and discharge ink droplets by this heat generation. Some printheads heat liquid by an electrothermal transducer having a heating resistance element.

Of these printheads, an inkjet printhead which discharges ink droplets by using heat energy can print at high resolution because orifices can be arrayed at high density. A printhead using an electrothermal transducer as an energy generating element can be easily downsized. This printhead can fully utilize advantages of the IC technology and microfabrication technology which are progressing rapidly and improving reliability in the latest semiconductor industry. In addition, this printhead facilitates high-density packaging and reduces the manufacturing cost.

These days, nozzles for discharging ink are arrayed at high density using photolithography in order to print at higher resolution.

Procedures to fill such a printhead with ink in an early stage will be explained with reference to FIG. 14.

In a printer of FIG. 14, a suction cap 207*a* of a recovery unit covers the nozzle face of a printhead 201 to tightly close the printhead 201. Then, a suction pump communicating with the cap sucks. The suction by the suction pump sets a negative pressure in the ink channel of the printhead 201 to discharge ink from nozzles to the cap. At the same time, bubbles in the ink are also discharged from the nozzles, thereby removing bubbles.

In this bubble removal by suction recovery, bubbles in the printhead can be removed, but ink is wasted in the recovery operation.

Japanese Patent Laid-Open No. 2000-301737 discloses a technique for solving the problem of suction recovery. In Japanese Patent Laid-Open No. 2000-301737, the internal pressure of an ink chamber in a printhead is reduced by a pressure reducing pump via an exhaust tube connected to the top of the ink chamber, releasing bubbles in the ink chamber into air. At the same time, ink is supplied into the ink chamber to raise the liquid level. A float member lower in specific gravity than ink is arranged. As the liquid level rises, the float member also rises to automatically close the exhaust tube so as not to discharge ink from the exhaust tube. This structure enables the bubble removal operation in the ink chamber without wasting ink.

DISCLOSURE OF INVENTION

However, in the bubble removal structure using the float valve, the operation of the float valve is obstructed, as shown in FIGS. 15 and 16A to 16C.

In FIG. 15, a discharge channel is formed above a liquid chamber 1*c* of a printhead, and a float housing 1*n* containing a float 1*g* and float sealing member 1*h* is arranged midway along the discharge channel.

A predetermined amount of bubbles generated upon a printing operation or the like is accumulated at an upper portion in the liquid chamber 1*c*, and liquid ink exists in the discharge channel extending from the top of the liquid chamber 1*c* to a float valve. In this state, liquid ink around the float valve generates buoyant force on the float 1*g*. The buoyant force brings the float 1*g* into contact with the float sealing member to always shut the discharge channel. Air cannot be removed from the discharge channel by a suction pump.

If bubbles in the liquid chamber 1*c* are removed while neither ink nor bubble exists around the float 1*g*, as shown in FIG. 16A, bubbles in the liquid chamber 1*c* flow into the float housing. The bubbles push up the float positioned at a lower portion. This phenomenon occurs because a film of bubbles is formed between the inner wall of the float housing 1*n* and the float 1*g* and, and when the film of bubbles comes up, the surface tension of the film pushes up the lightweight float 1*g* together.

As a result, before discharging bubbles, the float 1*g* comes into contact with the float sealing member 1*h* to shut the discharge channel. No bubble can be completely removed from the ink chamber. This phenomenon occurs more readily as the float housing becomes smaller.

The present invention provides a discharge device capable of effectively discharging bubbles in a liquid chamber from a discharge channel having a float member and float sealing member.

The present invention in its first aspect provides a discharging device comprising:

a liquid container configured to contain a liquid;

a discharge channel configured to discharge a fluid from the liquid container;

a float member configured to movably exist in the discharge channel, and move up together with the liquid to come into contact with a float sealing member arranged in the discharge channel, thereby shutting the discharge channel, the float member being lower in specific gravity than the liquid;

separating means configured to separate the float member from the float sealing member;

suction means configured to discharge the fluid from the liquid container via the discharge channel; and control means configured to operate the separating means when operating the suction means.

The present invention in its second aspect provides a printing apparatus comprising:

an orifice configured to discharge a liquid to print on a print medium;

a liquid container configured to contain the liquid to be supplied to the orifice;

a discharge channel configured to discharge a fluid from the liquid container;

a float member configured to movably exist in the discharge channel, and move up together with the liquid to come into contact with a float sealing member arranged in the discharge channel, thereby shutting the discharge channel, the float member being lower in specific gravity than the liquid;

separating means configured to separate the float member from the float sealing member;

suction means configured to discharge the fluid from the liquid container via the discharge channel; and control means configured to operate the separating means when operating the suction means.

The present invention in its third aspect provides a printing apparatus comprising:

an orifice configured to discharge a liquid to print on a print medium;

a liquid container configured to supply the liquid to the orifice;

negative pressure generating means configured to set a negative pressure in the liquid container;

a discharge channel configured to discharge a fluid from the liquid container;

a float member configured to movably exist in the discharge channel, and move up together with the liquid to come into contact with a float sealing member arranged in the discharge channel, thereby shutting the discharge channel, the float member being lower in specific gravity than the liquid;

air release means configured to make a downstream side of the discharge channel below the float sealing member communicate with air;

suction means configured to discharge the fluid from the liquid container via the discharge channel; and control means configured to cause the air release means to make an interior of the discharge channel communicate with air before or after operating the suction means.

The present invention can effectively discharge bubbles in a liquid chamber from a discharge channel having a float member and float sealing member.

Further features of the present invention will become apparent from the following description of exemplary embodiments with reference to the attached drawings.

BEST MODE FOR CARRYING OUT THE INVENTION (First Embodiment)

The first embodiment of the present invention will be described below with reference to the accompanying drawings.

Figure 1:
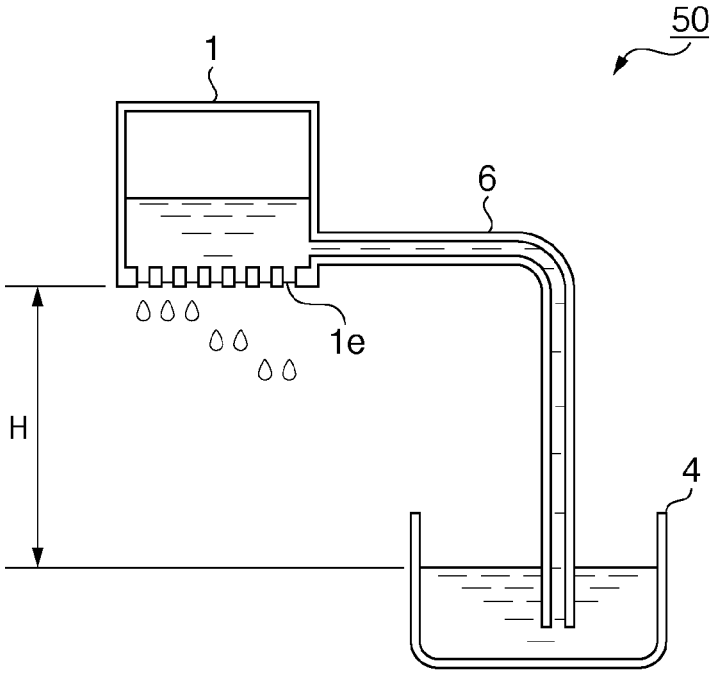
FIG. 1 is a sectional view for explaining the basic principle of ink supply in an inkjet printing apparatus according to an embodiment of the present invention.
Figure 2:
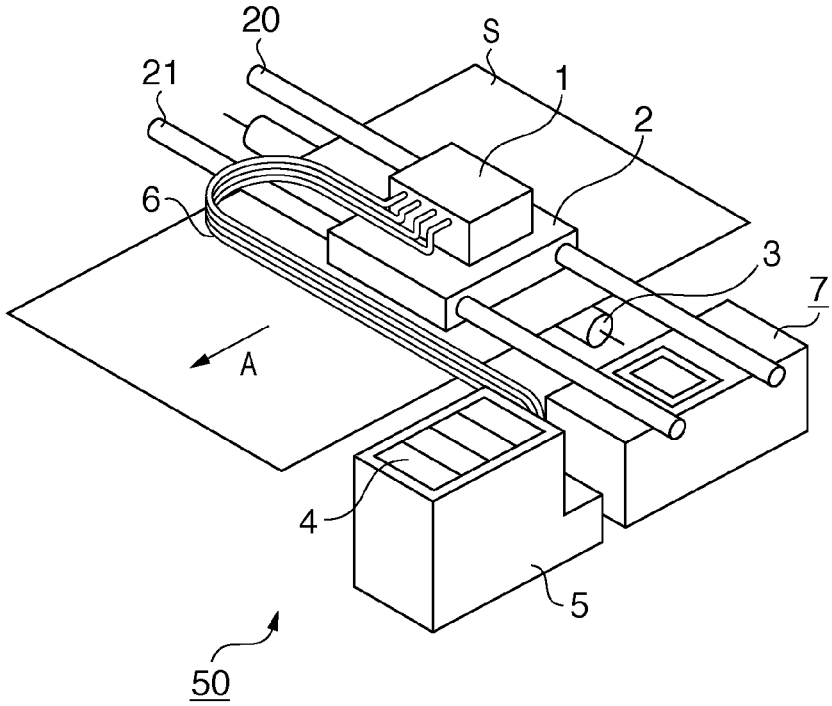
FIG. 2 is a perspective view schematically showing the structure of the inkjet printing apparatus according to the embodiment of the present invention.
Figure 3:
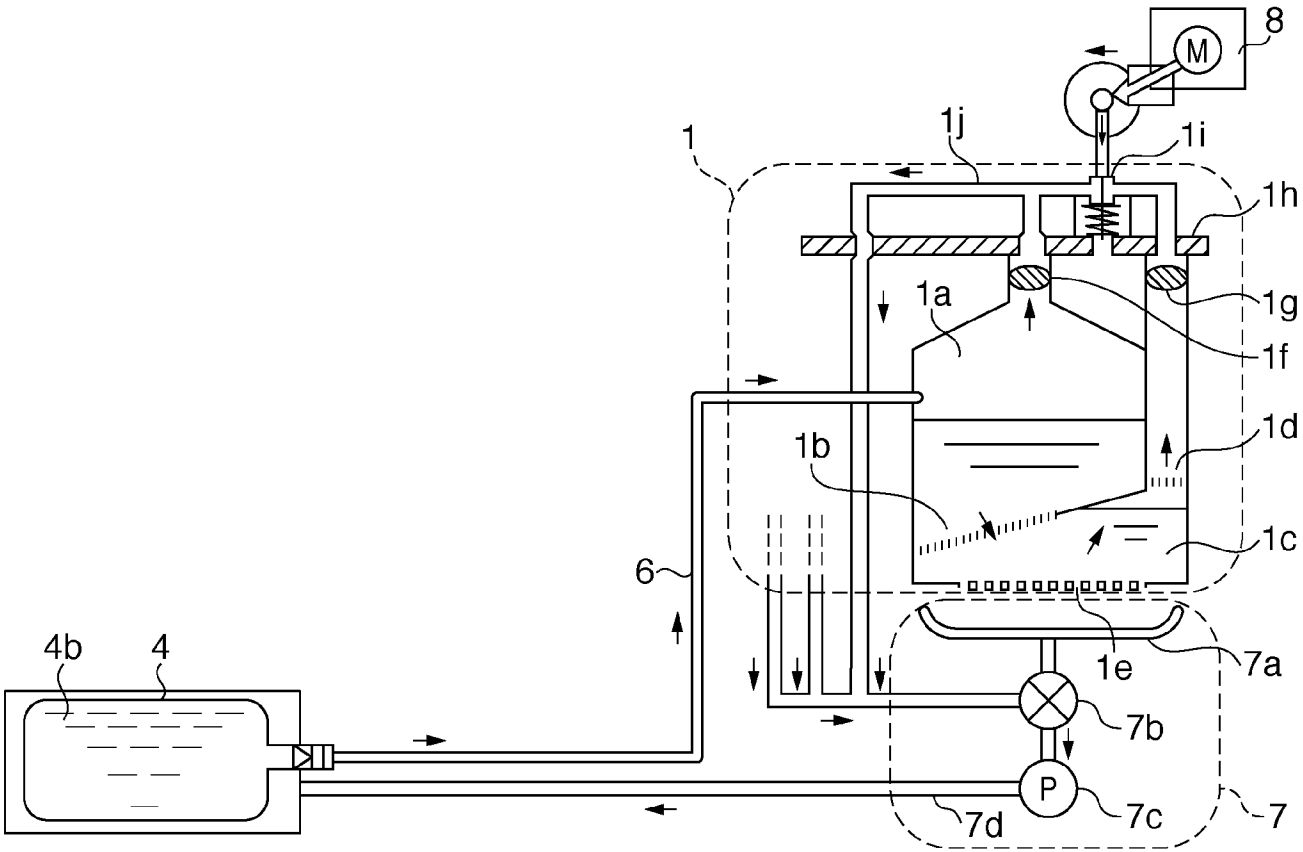
FIG. 3 is a schematic view schematically showing an ink supply device according to the embodiment of the present invention.
Figure 6:
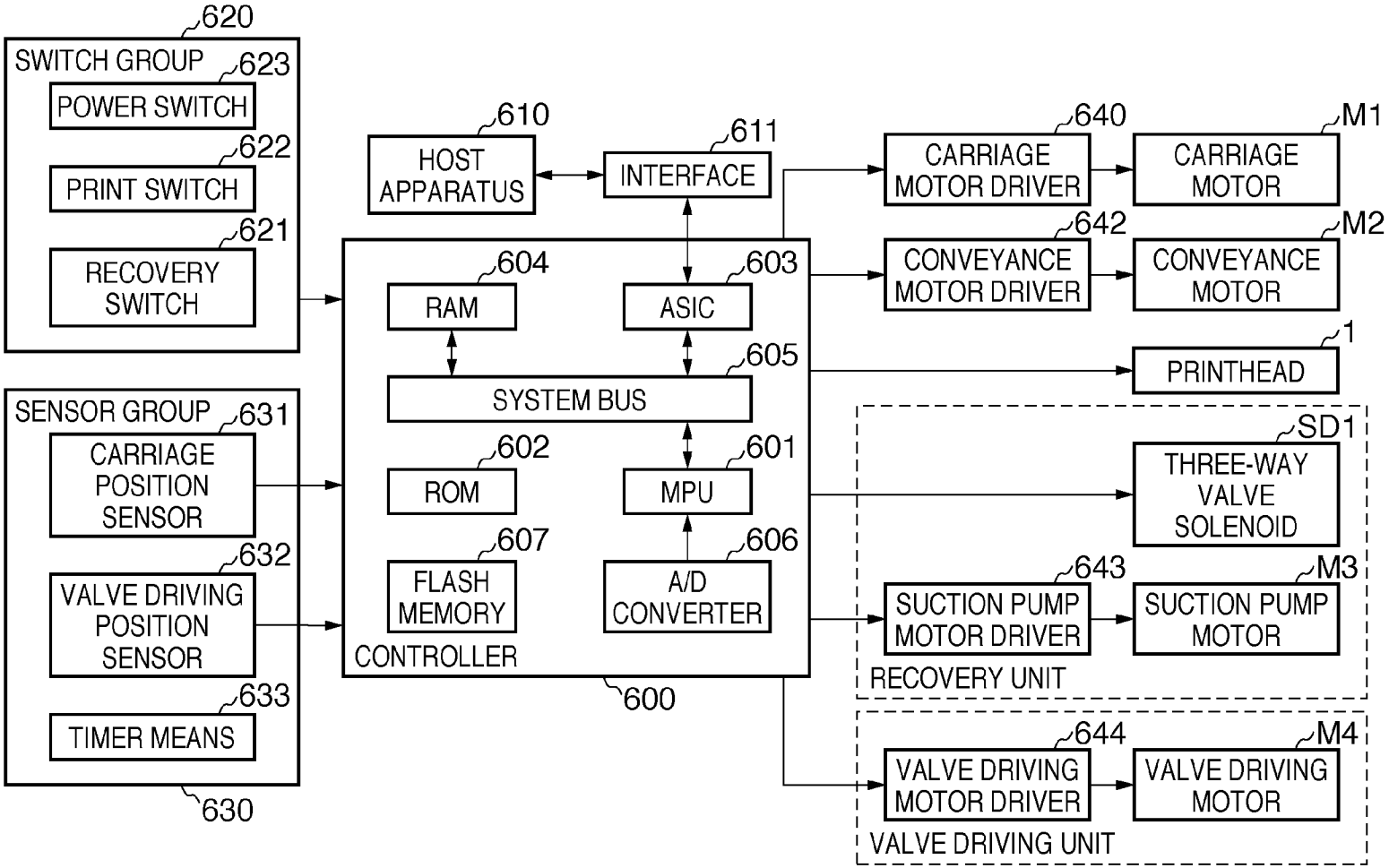
FIG. 6 is a block diagram showing the control arrangement of the inkjet printing apparatus according to the first embodiment of the present invention.

FIG. 1 is a sectional view for explaining the basic principle of ink supply in an inkjet printing apparatus according to the first embodiment of the present invention. FIG. 2 is a perspective view schematically showing the structure of the inkjet printing apparatus according to the first embodiment of the present invention. FIG. 3 is a schematic view for explaining an ink supply channel for one color in the inkjet printing apparatus of FIG. 2. FIG. 6 is a block diagram showing the control arrangement of the inkjet printing apparatus of FIGS. 1, 2, and the like in the first embodiment.

The basic principle of ink supply to a printhead 1 in an inkjet printing apparatus 50 according to the first embodiment will be explained with reference to FIG. 1.

In the inkjet printing apparatus 50, as shown in FIG. 1, the printhead 1 communicates with a main tank 4 via a supply tube 6. A channel extending from the main tank 4 to discharge nozzles (orifices) 1*e* of the printhead 1 is filled with ink. The discharge nozzles 1*e* of the printhead 1 are arranged at a position higher by a height H than the liquid level of ink stored in the main tank 4 to keep the interior of the printhead 1 at a negative pressure corresponding to a head difference of the height H. The inkjet printing apparatus 50 adopts a system (called a head difference method) which generates a negative pressure on ink in the printhead depending on the level difference between the main tank serving as a negative pressure generating means (a negative pressure generating unit) and the discharge nozzle surface of the printhead. The printhead 1 stores a predetermined amount of ink. The method of always generating a negative pressure on ink in the printhead is not limited to the head difference method.

The discharge nozzle 1*e* of the printhead 1 is formed as a small hole. Since the interior of the printhead 1 is set at a negative pressure, as described above, the interior of the discharge nozzle 1*e* is also set at a negative pressure. Thus, ink in the nozzle forms a meniscus at the distal end of the nozzle, preventing leakage of ink from the discharge nozzle 1*e* and entrance of air from the atmosphere into the discharge nozzle 1*e*. Ink is discharged by pushing ink from the discharge nozzle 1*e* by film boiling energy of a heater (not shown) arranged in the discharge nozzle 1*e*. After discharging ink, the nozzle is filled with ink again by the capillary force of the discharge nozzle 1*e*. This cycle is repeated to suck up ink again from the main tank 4 to the printhead 1 via the supply tube 6.

As shown in FIG. 6, a controller 600 serving as a control means (a control unit) comprises an MPU 601, and a ROM 602 which stores programs corresponding to control sequences (to be described later), predetermined tables, and other permanent data. An ASIC (Application Specific Integrated Circuit) 603 of the controller 600 controls a carriage motor M1, a conveyance motor M2, and a suction pump motor M3 of a recovery unit. Further, the ASIC 603 generates control signals for a three-way valve solenoid SD1 of the recovery unit, a valve driving motor M4 of a valve driving unit, and the printhead.

A RAM 604 has an image data rasterization area, a work area for executing a program, and the like. A system bus 605 connects the MPU 601, ASIC 603, and RAM 604 to each other, and allows exchanging data.

The controller 600 further comprises, for example, an A/D converter 606 which receives analog signals from a sensor group (to be described below), A/D-converts them, and supplies digital signals to the MPU 601.

In FIG. 6, a computer (or an image reader, digital camera, or the like) 610 serves as an image data source and is generically called a host apparatus. The host apparatus 610 and controller 600 transmit/receive image data, commands, status signals, and the like via an interface (I/F) 611.

A switch group 620 has switches for receiving instruction inputs from the operator. The switch group 620 includes a power switch 623, a print switch 622 for designating the start of printing, and a recovery switch 621 for designating activation of processing (recovery processing) for maintaining good ink discharge performance of the printhead 1.

A sensor group 630 detects an apparatus state. The sensor group 630 includes a carriage position sensor 631, a valve driving position sensor 632, and a timer means 633. The carriage position sensor 631 is formed from a photocoupler or the like for detecting a home position h of a carriage. The valve driving position sensor 632 detects the level position of an air release valve 1*i* serving as an air release means (an air release means) for releasing the interior of the printhead 1 to air. More specifically, the carriage position sensor 631 is formed from a photocoupler or the like for detecting the home position of a cam mechanism in the valve driving unit for controlling the level position of the air release valve 1*i*. The timer means 633 notifies the MPU 601 in the controller 600 of the bubble removal suction timing, time period, and the like.

A carriage motor driver 640 drives the carriage motor M1 for reciprocating a carriage 2 in directions indicated by an arrow A. A conveyance motor driver 642 drives the conveyance motor M2 for conveying a print medium P.

A suction pump motor driver 643 drives the suction pump motor M3 for operating a suction pump. A valve driving motor driver 644 drives the valve driving motor M4.

With this arrangement, the printing apparatus main body analyzes print data commands transferred via the interface 611, and rasterizes image data used to print in the RAM 604.

The image data rasterization area (rasterization buffer) is a 2D rectangular area. The lateral size of the image data rasterization area corresponds to the number Hp of pixels of a printable area in the carriage moving direction (main scanning direction). The longitudinal size of the image data rasterization area corresponds to ¼ (i.e., 64c pixels) of 16×16c pixels in the conveyance direction (sub-scanning direction) of a print medium printed by one print scanning of the printhead. This image data rasterization area is ensured in the RAM 604.

A storage area (print buffer) in the RAM 604 that is referred to in order to transfer print data to the printhead 1 in print scanning is also a 2D rectangular area. The lateral size of the storage area corresponds to the number Vp of pixels of a printable area in the main scanning direction. The longitudinal size of the storage area corresponds to 16×16c pixels in the sub-scanning direction of a print medium printed by one print scanning of the printhead.

In print scanning by the printhead 1, the ASIC 603 transfers driving data DATA of a printing element (discharge heater) to the printhead while directly accessing the storage area of the RAM 604.

In the serial inkjet printing apparatus 50 shown in FIG. 2, the printhead 1 moves in the main scanning direction to print on a print sheet S which is conveyed by a feed roller 3 in a direction indicated by the arrow A serving as the sub-scanning direction.

Reciprocation (main scanning) of the printhead 1 in the main scanning direction, and conveyance (sub-scanning) of the print sheet S at a predetermined pitch in the sub-scanning direction are alternately repeated. In synchronism with these movements, ink is selectively discharged from a plurality of discharge nozzles 1*e* of the printhead 1 and attached to the print sheet S, forming a character, sign, image, or the like.

The printhead 1 is detachably mounted on the carriage 2 which is slidably supported by two guide rails 20 and 21, and reciprocates along the guide rails by a driving means (not shown) such as a motor.

The print sheet S is conveyed by the feed roller 3 in a direction (e.g., the direction indicated by the arrow A) perpendicular to the moving direction of the carriage 2 so as to face the ink discharge surface of the printhead 1 and maintain a predetermined distance from the ink discharge surface. The nozzle array of the printhead 1 runs in a direction almost perpendicular to the main scanning direction of the printhead 1. A plurality of independent main tanks 4 are detachably mounted in an ink supply unit 5 in correspondence with the colors of inks discharged from the printhead 1. The ink supply unit 5 and printhead 1 are connected by a plurality of supply tubes 6 corresponding to respective ink colors. When the main tanks 4 are mounted in the ink supply unit 5, respective color inks stored in the main tanks 4 can be independently supplied to the respective nozzle arrays of the printhead 1.

A recovery unit 7 is arranged adjacent to the ink supply unit 5 and faces the ink discharge surface of the printhead 1 within the reciprocal range of the printhead 1 and in a non-printing area outside the range where the print sheet S passes.

The recovery unit 7 incorporates a suction pump 7*c* used on the reduced-pressure side. The recovery unit 7 cleans each discharge nozzle 1*e* by forcibly sucking ink or air in the nozzle from the discharge nozzle 1*e* of the printhead 1 via a suction cap. The suction pump 7*c* of the recovery unit 7 is connected via a three-way valve 7*b* to discharge channels containing float valves respectively arranged in the sub-tank and liquid chamber of the printhead. The suction pump 7*c* removes bubbles in the sub-tank and liquid chamber.

As shown in FIG. 3, the inkjet printing apparatus roughly comprises the printhead 1 for discharging ink, the ink supply unit 5 for supplying ink to the printhead, and the recovery unit 7 for performing a recovery operation for the printhead 1. The structures of the printhead 1, ink supply unit 5, and recovery unit 7 will be explained in order.

A sub-tank 1*a* is arranged at an upper portion in the printhead 1 as an ink chamber for holding a predetermined amount of ink. A liquid chamber 1*c* is formed below the sub-tank 1*a* to directly supply ink to a plurality of parallel-arrayed discharge nozzles 1*e*. The sub-tank 1*a* and liquid chamber 1*c* form a liquid container. A connector insertion port is formed in the side surface of the sub-tank 1*a* to connect the supply tube 6. An opening is formed at the boundary between the sub-tank 1*a* and the liquid chamber 1*c*, and an inlet filter 1*b* is arranged in the opening. In this manner, the sub-tank 1*a* communicates with the discharge nozzles 1*e* via the inlet filter 1*b* and liquid chamber 1*c*, and has a channel structure for supplying ink to the discharge nozzles. Bubble discharge paths (discharge channels) 1*j* are arranged at upper portions in the sub-tank and liquid chamber to discharge a fluid such as bubbles. Two discharge channels are merged on the downstream side (the side on which the filter exists is the upstream side), and discharge channels for respective colors are integrated on the downstream side. The integrated discharge channel is connected to the suction pump 7*c* in the recovery unit via an exhaust-only flexible tube so that the printhead can reciprocate in the main scanning direction. An outlet filter 1*d* is arranged at a joint with a discharge channel at an upper portion in the liquid chamber.

In the first embodiment, the downstream side from the bubble discharge path is connected to the suction pump 7*c* in the recovery unit via the exhaust-only flexible tube, but another structure is also available. For example, a bubble discharge path and bubble discharge port may also be arranged in only the printhead. In this case, when the printhead comes to face the recovery unit, bubbles are removed by the suction pump via a bubble discharge cap tightly connected to the bubble discharge port. This will be called a pit-in method.

Float housings (float chambers) are respectively arranged midway along the discharge channel above the outlet filter 1*d* of the liquid chamber and the discharge channel of the sub-tank. Floats 1*f* and 1*g* are movably arranged in the float housings (float chambers). Each of the floats 1*f* and 1*g* is formed from a member lower in specific gravity than ink serving as a liquid, and moves up together with the rise of the ink liquid level. A float sealing member 1*h* is formed at an upper portion in the float chamber. The floats 1*f* and 1*g* which move up together with the ink liquid level abut against the float sealing member 1*h*, shutting the channels.

The float member lower in specific gravity than ink whose main component is water is preferably formed from, for example, polypropylene (PP) having a specific gravity of 0.93. The float member may also be formed from another material as long as it is lower in specific gravity than water serving as the main component of the ink medium.

The shape of the floats 1*f* and 1*g* needs to have a good contact with the float sealing member 1*h*. For example, the floats 1*f* and 1*g* preferably have a ball- or sheet-like shape for the float sealing member having circular holes as shown in FIG. 3. The floats 1*f* and 1*g* may also have a shape with a good contact, other than the ball- or sheet-like shape.

If the float sealing member 1*h* is formed from an elastic elastomer resin, rubber material, or the like with respect to the float member of the inelastic PP material, the contact area with the float member is widened, improving the contact characteristic. The float sealing member may also be formed from a material other than the elastomer resin or rubber material.

The air release valve 1*i* is arranged midway along a discharge channel for each color so that the discharge channel can communicate with air. The release valve is opened/closed by a valve driving unit 8 arranged on the printer main body side.

The discharge nozzle 1*e* has a small cylindrical structure with a section diameter of about 20 μm. The discharge nozzle 1*e* discharges ink by applying discharge energy to ink in the discharge nozzle 1*e*. After discharging ink, the discharge nozzle 1*e* is filled with ink by the capillary force of the discharge nozzle 1*e*. In general, this discharge operation is repeated in a cycle of 20 kHz or more in order to form an image at high speed. In order to apply discharge energy to ink in the discharge nozzle 1*e*, the printhead 1 has an energy generating means for each discharge nozzle 1*e*. As the energy generating means, the first embodiment adopts a heating resistance element which heats ink in the discharge nozzle 1*e*. The heating resistance elements are selectively driven in accordance with an instruction (driving signal) from the controller 600 serving as a head control unit, film-boiling ink in desired discharge nozzles 1*e*. The pressure of bubbles generated by the film boiling discharges ink from the discharge nozzles 1*e*.

As described above, the discharge nozzle 1*e* is filled with ink while ink forms a meniscus. To implement this, the interior of the printhead 1, especially that of the discharge nozzle remains at a negative pressure. If the negative pressure is excessively low and a foreign substance or ink is attached to the distal end of the discharge nozzle, the ink meniscus is lost, and ink may leak from the discharge nozzle. To the contrary, if the negative pressure is excessively high, a force to attract ink back into the discharge nozzle 1*e* becomes larger than energy applied to ink in discharge, causing a discharge failure. From this, the negative pressure in the discharge nozzle is preferably held in a predetermined range slightly lower than the atmospheric pressure.

The range of the negative pressure is preferably −40 mmAq (about −0.0040 atm =−4.053 kPa) to −200 mmAq (about −0.0200 atm =−2.0265 kPa) (the specific gravity of ink that of water). However, the range of the negative pressure changes depending on the number of discharge nozzles 1*e*, the sectional area, the performance of the heating resistance element, and the like.

The inlet filter 1*b* prevents outflow of a foreign substance, which may clog the discharge nozzle, from the sub-tank 1*a* to the liquid chamber 1*c*. The inlet filter 1*b* is formed from a metal net having small meshes of 10 μm or less, which is smaller than the sectional width of the discharge nozzle. As the size of the small mesh decreases, the meniscus strength increases, and air hardly passes.

Similar to the inlet filter, the outlet filter 1*d* also prevents inflow of a foreign substance, which may clog the discharge nozzle, from the discharge channel above the outlet filter 1*d*. The filter material, mesh size, and the like are preferably the same as those of the inlet filter.

The ink supply unit and the main tank connected to it will be explained.

The main tank 4 is detachable from the ink supply unit 5. A rigid ink case incorporates an ink bag for storing liquid ink, and an ink outlet is formed in part of the ink bag. The periphery of the ink bag in the ink case is exposed to air.

An ink supply needle arranged in the ink supply unit 5 sticks the ink inlet of the main tank, and then the main tank 4 inserted into the ink supply unit 5 communicates with ink in the ink bag. When the main tank 4 is mounted in the ink supply unit 5, ink in the main tank 4 is supplied into the sub-tank of the printhead via the ink supply needle and the ink supply tube 6. At least part of the supply tube 6 is formed from a flexible tube so that the printhead 1 can reciprocate in the main scanning direction in printing and the like.

The above-described ink supply channel structure from the main tank 4 to the printhead 1 is arranged for each color (for example, for black, yellow, cyan, and magenta for a four-color printer).

The recovery unit 7 will be explained. The recovery unit 7 has a suction recovery operation function of sucking ink and bubbles from the discharge nozzle, and a bubble removal operation function of discharging bubbles from each ink chamber in the printhead via the float valve. In addition, the recovery unit 7 has a capping means for capping the discharge surface of the printhead.

A suction cap 7*a* is connected to a tube, and the suction pump 7*c* is arranged at the intermediate position of the tube. The suction pump 7*c* is driven by the suction pump motor M3 (FIG. 6). The suction cap 7*a*, tube, suction pump 7*c*, and suction pump motor M3 serve as a suction means (a suction unit) for sucking ink in the printhead 1 from the discharge nozzle at a predetermined timing.

At least a portion of the suction cap 7*a* that contacts the ink discharge surface is formed from an elastic member such as rubber. The suction cap 7*a* is movable between a capping position where the suction cap 7*a* tightly covers the ink discharge surface, and a retract position where the suction cap 7*a* is spaced apart from the printhead 1. The suction pump 7*c* is a tube type pump having a plurality of rollers. The suction pump 7*c* can continuously such ink by driving the suction pump motor M3. The suction pump 7*c* can change the suction amount in accordance with the number of revolutions of the suction pump motor M3.

In the tube between the suction pump 7*c* and the suction cap 7*a*, a three-way valve 7*b* merges channels obtained by integrating a plurality of discharge channels each containing the float valve of each color head. The three-way valve 7*b* can switch to connect the suction pump 7*c* to either the suction cap 7*a* or the discharge channel 1*j* on the float valve side. Waste ink discharged by the bubble removal operation of the suction pump 7*c* and waste ink discharged from the printhead by the suction cap 7*a* are recovered to a waste ink container in the main tank 4.

The inkjet printing apparatus of the first embodiment discharges ink by operating the heating element of each discharge nozzle in accordance with an image signal. For this reason, the temperature of the discharge nozzle 1*e* rises, and bubbles are accumulated in the sub-tank 1*a* and liquid chamber 1*c*.

The MPU 601 in the controller 600 shown in the block diagram of FIG. 6 always counts the number of discharge operations of discharging ink from the printhead 1. When the discharge count reaches a predetermined value, the MPU 601 reads out a bubble removal suction operation program stored in the ROM 602 to designate the bubble removal suction operation. Then, the bubble removal suction operation to be described later is executed.

Figure 5A:
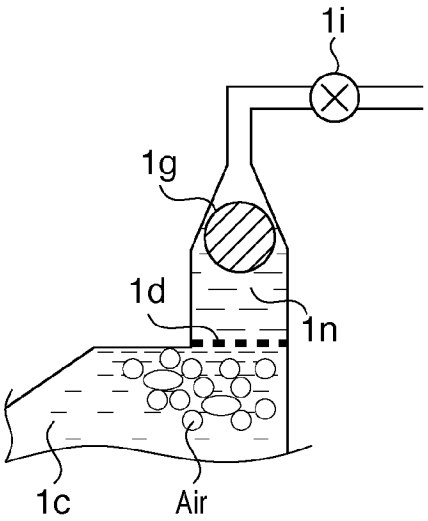
FIGS. 5A to 5C are sectional views showing bubble removal states at a float valve in the bubble removal sequence operation executed in the embodiment of the present invention.

If the printer main body has not printed for a long time, gas such as oxygen or nitrogen enters ink in the liquid chamber mainly via the discharge nozzle and the like in a long time, accumulating bubbles, like the state in FIG. 5A. To prevent this, the timer means 633 of the printer main body counts the time elapsed after the end of the printing operation. If the MPU 601 determines that the elapsed time has exceeded a predetermined time, it designates the bubble removal suction operation.

When the printer main body is turned on, data such as the ink discharge count and the time when the printing operation ended are stored in the MPU 601. When the printer main body is turned off, these data are stored in a flash memory 607 in the controller. When the printer main body is turned on again, data such as the ink discharge count and time stored in the flash memory are stored in the MPU, causing the MPU to detect the bubble removal suction operation timing.

Figure 4A:
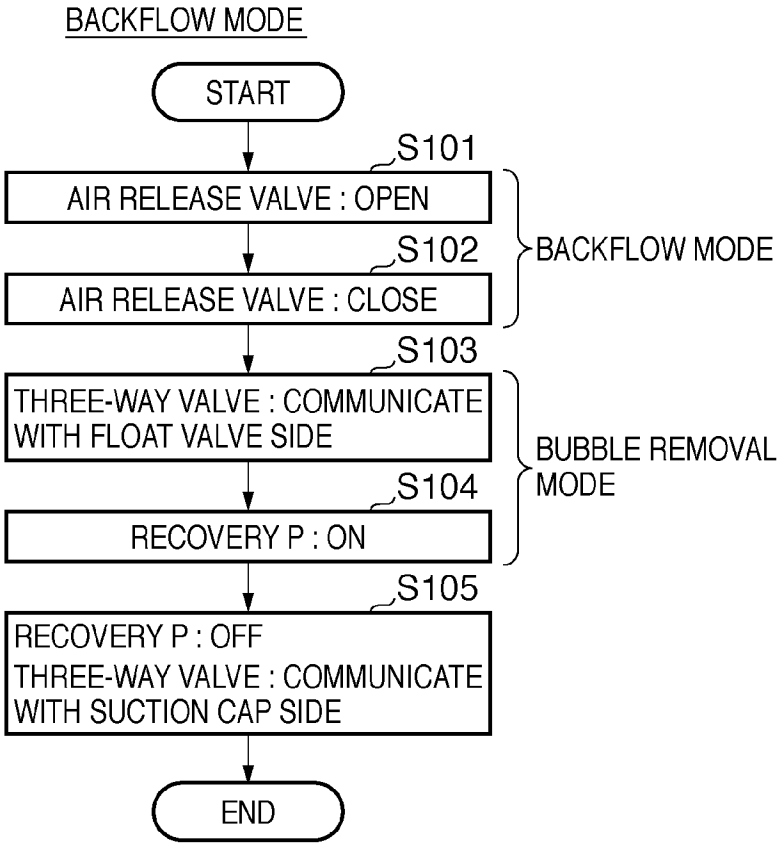
FIGS. 4A and 4B are flowcharts showing bubble removal sequences executed in the embodiment of the present invention.
Figure 5B:
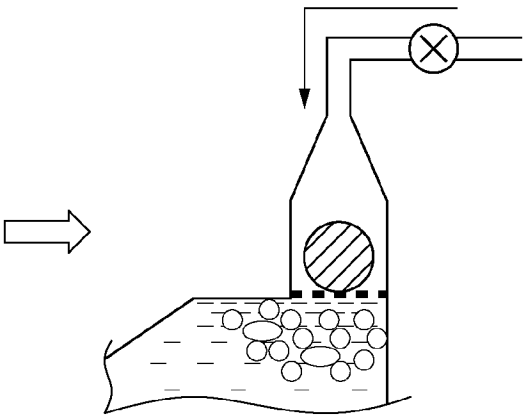
Figure 5C:
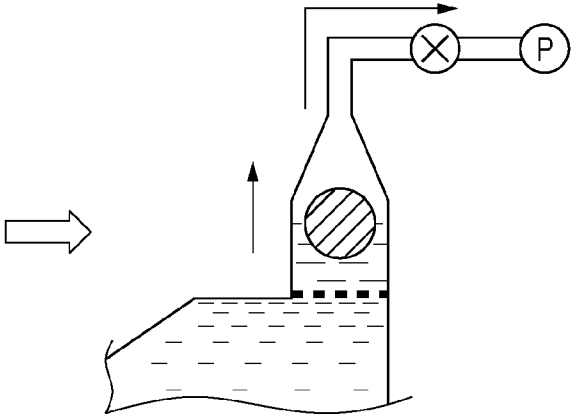

FIG. 4A is a flowchart showing an operation sequence to open the float housing to air by the float valve and make ink flow back before the bubble removal suction operation. FIGS. 5A to 5C are sectional views of the periphery of the float valve schematically showing an operation when bubbles in the sub-tank 1*a* and liquid chamber 1*c* are removed.

FIG. 5A shows a state in which bubbles are accumulated in the sub-tank 1*a* and liquid chamber 1*c* of the printhead 1, and ink serving as a liquid is accumulated in the float housing 1*n* above the outlet filter 1*d*. If the MPU 601 issues a bubble removal suction operation instruction in the state, the air release valve 1*i* remains open for a predetermined time in step S101 to make ink in the float housing 1*n* flow back. After the air release valve 1*i* is open, the liquid level which reaches an upper portion in the float housing 1*n* falls to the outlet filter 1*d* owing to a negative pressure always applied to ink in the printhead, as shown in FIG. 5B. After the liquid level falls to the outlet filter 1*d*, the capillary force generated in the outlet filter 1*d* prevents the liquid level of back-flowing ink from falling from the outlet filter 1*d*.

The time during which the air release valve 1*i* remains open is generally about 10 sec to 2 min though it changes depending on the volume of a channel from the outlet filter 1*d* to the float valve and the value of a negative pressure acting on ink in the liquid chamber 1*c*. After the air release valve 1*i* remains open for a predetermined time and the ink liquid level is maintained at the position of the outlet filter 1*d*, the air release valve is closed (step S102).

In step S103, the three-way valve 7*b* is switched to connect the bubble discharge channel 1*j* to the suction pump 7*c*. In step S104, the suction pump 7*c* operates to reduce the pressure in the float housing 1*n* (recovery pump ON) and discharge bubbles in the liquid chamber 1*c* and sub-tank 1*a* from the float valve.

As the suction pump 7*c* sucks and discharges gas from the float housing 1*n*, the ink liquid levels in the sub-tank 1*a* and liquid chamber 1*c* of the printhead rise. As shown in FIG. 5C, the liquid level further rises in the float housing 1*n*. Upon the rise of the liquid level, the floats 1*f* and 1*g* in the float housing 1*n* are pressed against the float sealing member 1*h*, shutting the bubble discharge channel 1*j* before ink reaches the bubble discharge channel 1*j*. In this way, only bubbles are automatically discharged by the float valve while preventing discharge of ink. The bubble removal recovery operation can be executed without wasting ink.

After the suction pump 7*c* operates for a predetermined time, it stops in step S105 (recovery pump OFF). The suction pump 7*c* stops upon the lapse of time enough to close the float valve.

In step S105, the three-way valve 7*b* is switched to connect the suction cap 7*a* to the suction pump 7*c*, ending the bubble removal mode.

Figure 4B:
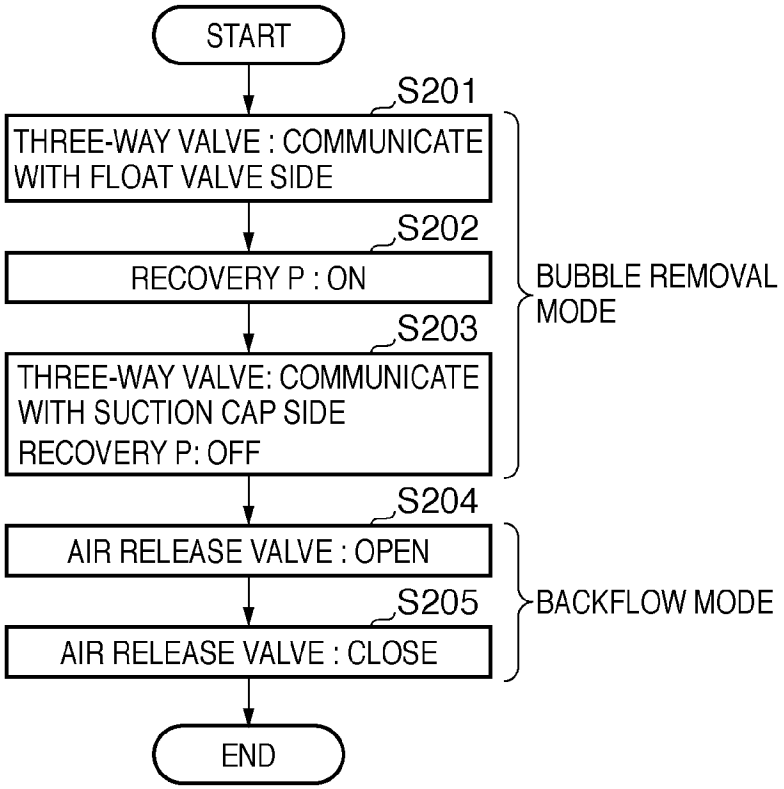

FIG. 4B is a flowchart showing an operation sequence to execute the above-described backflow operation after each bubble removal suction operation.

In step S201, the three-way valve 7*b* is switched to connect the bubble discharge channel 1*j* to the suction pump 7*c*. In step S202, the suction pump 7*c* operates to reduce the pressure in the float housing 1*n* (recovery pump ON) and discharge bubbles in the liquid chamber 1*c* and sub-tank 1*a* from the float valve. In step S203, the three-way valve 7*b* is switched to connect the suction cap 7*a* to the suction pump 7*c* (recovery pump OFF).

The air release valve 1*i* remains open for a predetermined time in step S204, and is closed in step S205.

Which of the sequence operations in FIGS. 4A and 4B is executed is arbitrary because what is important is to perform the bubble removal suction operation after eliminating ink from the float housing 1*n* before the bubble removal suction operation.

(Second Embodiment)

Figure 7:
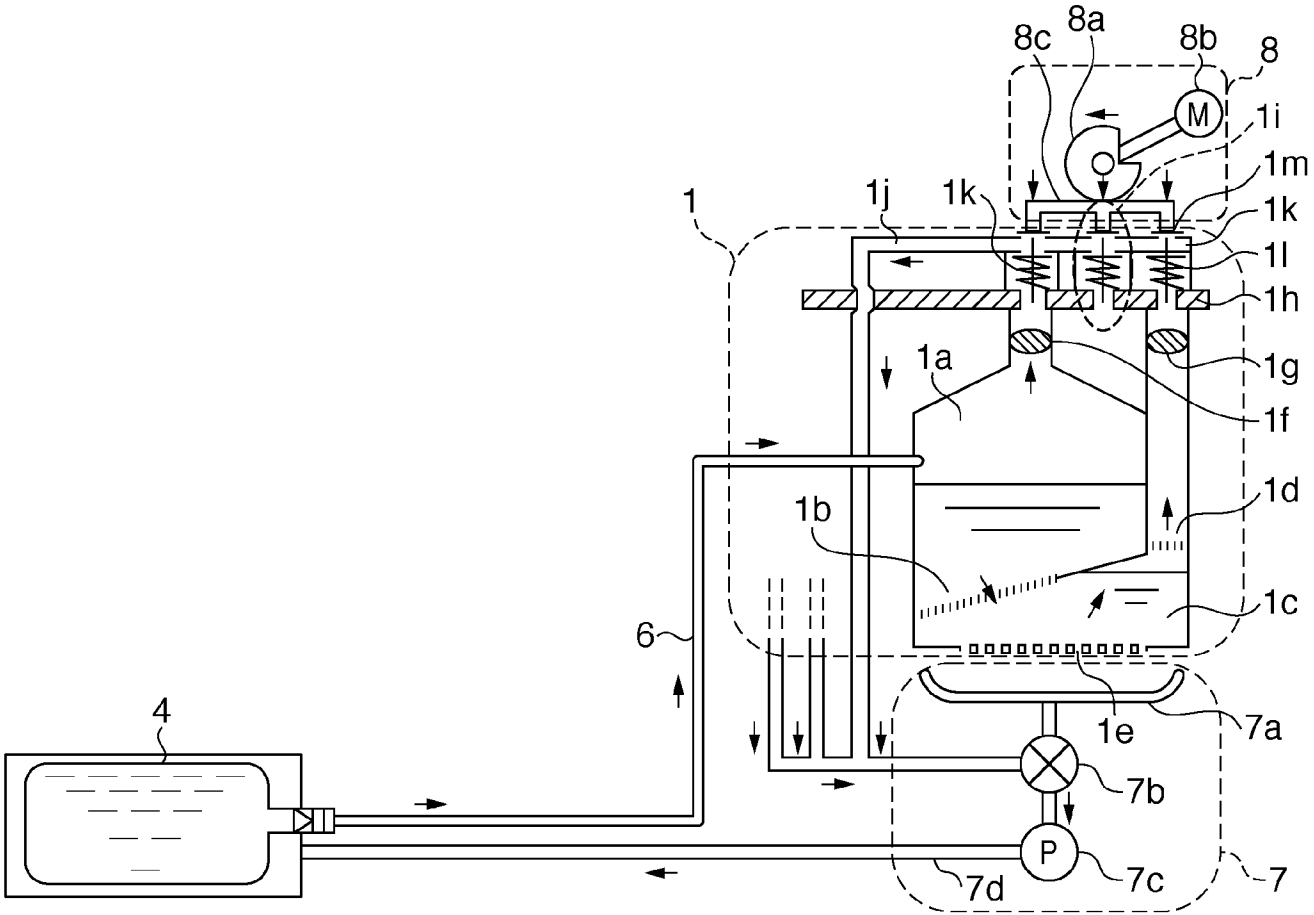
FIG. 7 is a sectional view schematically showing an ink supply device according to the second embodiment of the present invention.

FIG. 7 is a sectional view showing an ink supply structure according to the second embodiment.

The second embodiment adopts a float push-down mechanism (separating means or a separating unit) for separating the float member of a float valve from a float sealing member 1*h*.

The float push-down mechanism is arranged above the float sealing member 1*h*.

Each float push-down member 1*k* of the float push-down mechanism has one end which is shaped into a rod or pin and can extend through part of a bubble discharge channel 1*j* and enter a float housing 1*n*. The other end of the float push-down member 1*k* is formed from an elastic material, shaped into a valve body, and functions as an on-off valve sealing member.

Figure 8C:
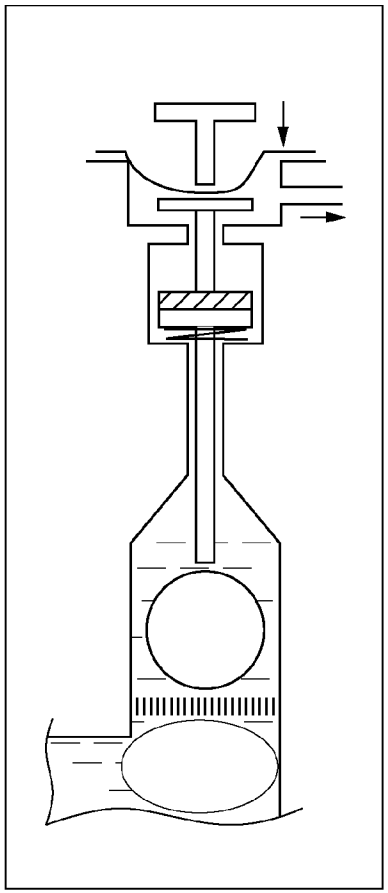
FIGS. 8A to 8C are sectional views showing in detail a float valve in the ink supply device according to the second embodiment of the present invention.
Figure 8B:
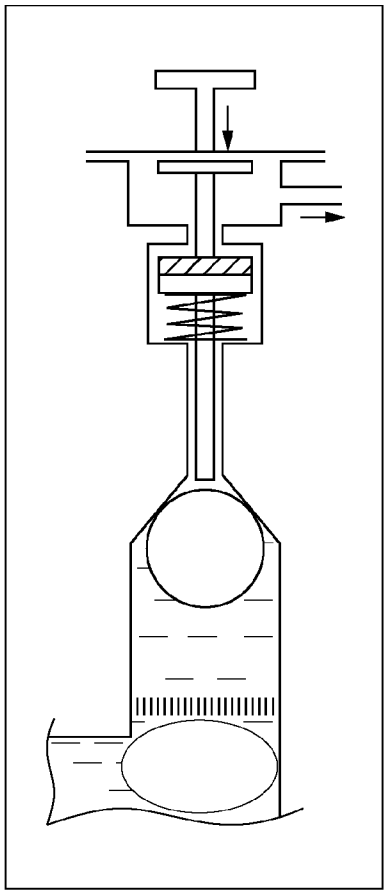
Figure 8A:
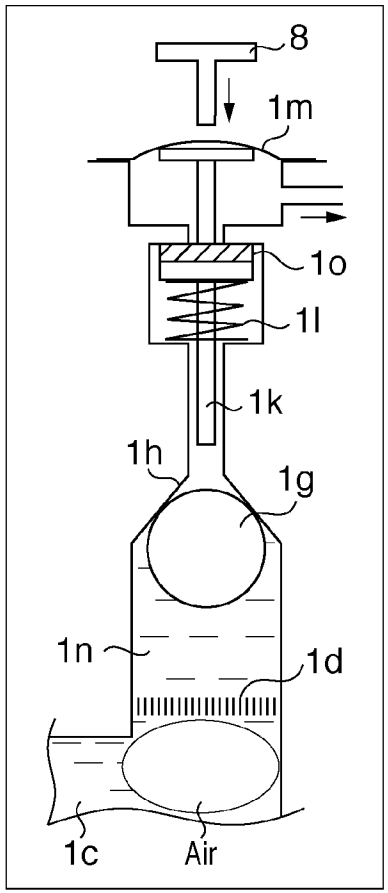

As shown in FIG. 8A, a float spring (compression spring) 11 pushes up the sealing member of a float on-off valve 1*o* of the float push-down member 1*k* against a valve seat to shut off the float housing 1*n* from the bubble discharge channel 1*j*.

The float push-down member 1*k* with this structure has two functions: a function of pushing down a float 1*g*, and an on-off valve function using the float on-off valve 1*o* arranged at the other end.

Vertical movement of the float push-down member 1*k* is externally controllable. Part of the discharge channel 1*j* is shut by a flexible film 1*m*. A valve driving controller (valve driving unit) 8 such as a cam can control the level position of the float push-down member 1*k* via the flexible film 1*m*. The flexible film is formed from, for example, a thin rubber film.

For example, when the float push-down member 1*k* is at an open position (uppermost position) serving as the first position, the float on-off valve is closed (state in FIG. 8A). When the float push-down member 1*k* is at an intermediate position, the float on-off valve 1*o* is open (state in FIG. 8B). When the float push-down member 1*k* is at the lowermost position, the float on-off valve 1*o* is open and the float 1*g* is pushed down (state in FIG. 8C).

The valve driving unit 8 comprises a valve driving motor 8*b*, a cam 8*a* which is rotated by the valve driving motor 8*b*, and a moving member 8*c* which moves vertically along with rotation of the cam 8*a* and when moving down, pushes down the float push-down member 1*k*.

Figure 9:
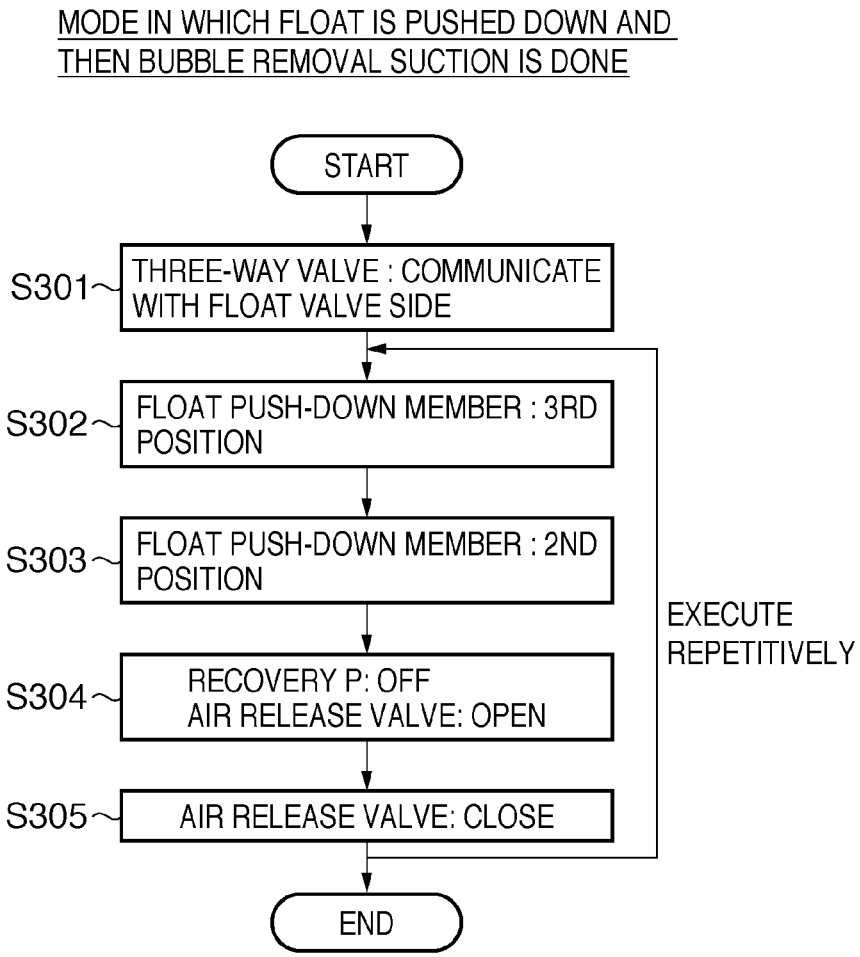
FIG. 9 is a flowchart showing a bubble removal sequence executed in the second embodiment of the present invention.

FIG. 9 is a flowchart showing a sequence operation to remove bubbles in a liquid chamber 1*c* by pushing down the float 1*g* and then performing the bubble removal suction operation according to the second embodiment.

Figure 10A:
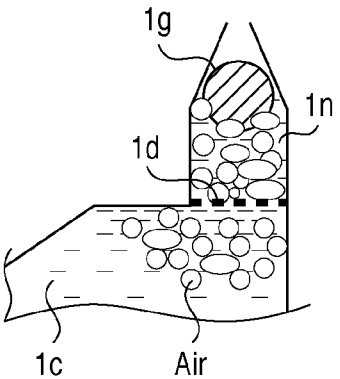
FIGS. 10A to 10D are sectional views showing bubble removal states at a float valve in the bubble removal sequence operation executed in the second embodiment of the present invention.

A float valve in the printhead of FIG. 7, particularly a float valve above an outlet filter 1*d* in the liquid chamber 1*c* allows bubbles and ink in the liquid chamber 1*c* simultaneously pass through the outlet filter 1*d* in the bubble removal operation (bubble removal suction) in the liquid chamber 1*c*. Thus, many bubbles move into the float housing 1*n*. The float 1*g*, which is arranged at a lower position before the bubble removal operation, is pushed up by bubbles, brought into contact with the float sealing member 1*h*, and sealed. As a result, the float valve is closed before the completion of bubble removal in the liquid chamber 1*c* (state in FIG. 10A). The phenomenon in which bubbles push up the float 1*g* is caused by the surface tension of a liquid film formed between the wall surface of the float housing 1*n* and the float 1*g*. This phenomenon more readily occurs as the gap between the wall surface of the float housing 1*n* and the float 1*g* is smaller, that is, the float housing 1*n* is smaller.

Figure 10B:
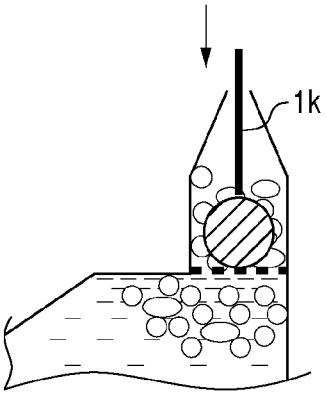
Figure 10C:
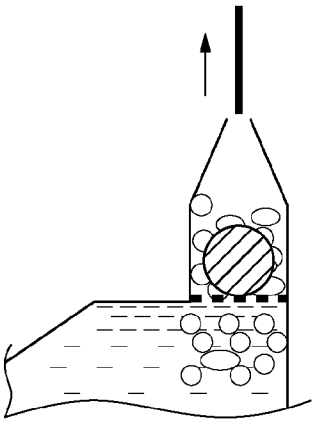
Figure 10D:
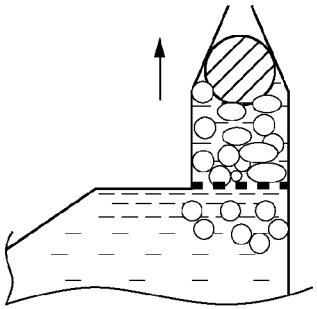

The operation of the second embodiment will be explained. In step S301 of FIG. 9, a three-way valve is switched to connect a suction pump 7*c* to the bubble discharge channel 1*j*. The valve driving motor 8*b* rotates the cam 8*a* to lower the level position of the float push-down member 1*k* to the third position (position in FIG. 8C) (step S302 in FIG. 9). The float 1*g* pushes away bubbles and moves down. Then, the cam 8*a* rotates to push up the float push-down member 1*k* to the second position (position in FIG. 8B). In this state, the suction pump 7*c* rotates for a predetermined time (step S303 in FIG. 9). Even if the float 1*g* which has been pushed up by bubbles is pushed down (state in FIG. 10B), and the float push-down member 1*k* moves up again (state in FIG. 10C), the float 1*g* is surrounded with bubbles, and thus no buoyant force acts on the float 1*g*. Even after the float push-down member 1*k* moves up, the float 1*g* remains pushed down. Then, the suction pump 7*c* is driven to perform bubble removal suction (S303 in FIG. 9), discharging bubbles above the float 1*g* to the bubble discharge channel 1*j*. At the same time, bubbles in the liquid chamber 1*c* move into the float housing 1*n* to push up the float and close the valve (state in FIG. 10D). The bubble removal operation can be done until the float valve is closed.

In step S304, the suction pump 7*c* stops to open the air release valve 1*i* (recovery pump OFF). In step S305, the air release valve 1*i* is closed, and the process returns to step S302 again. Steps S302 to 5305 are repeated a plurality of number of times.

Bubbles in the liquid chamber 1*c* can be removed by repeating the float push-down suction operation a plurality of number of times in the above-described way.

(Third Embodiment)

Figure 11:
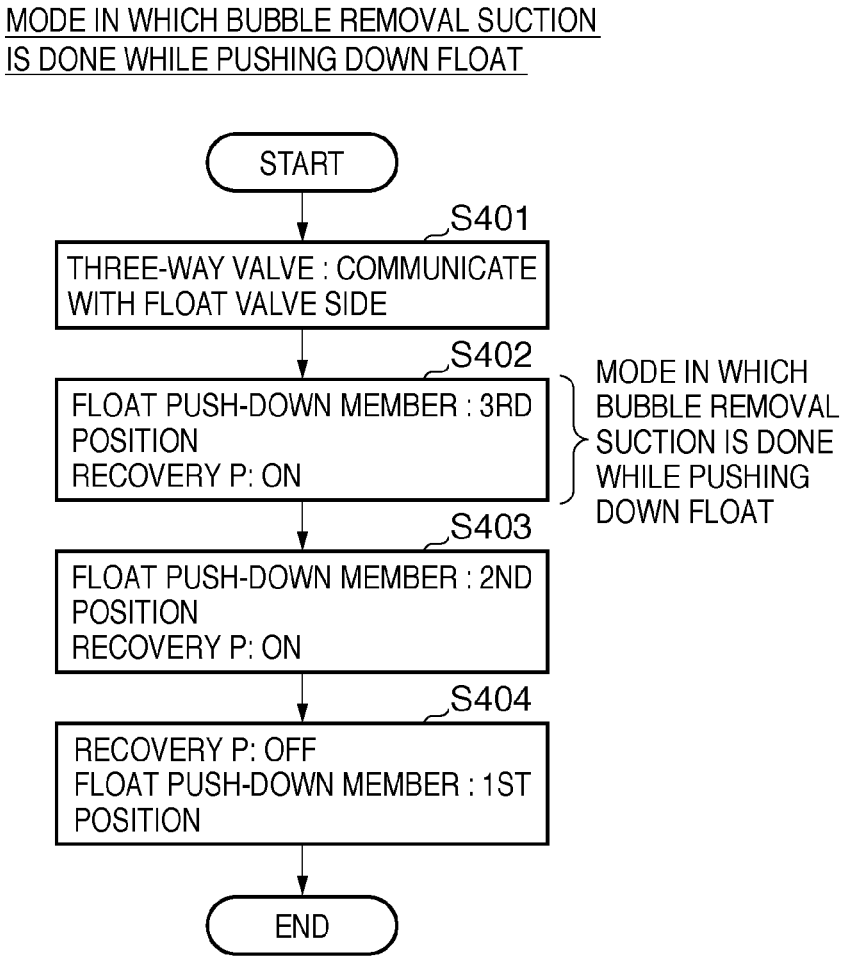
FIG. 11 is a flowchart showing a bubble removal sequence executed in the third embodiment of the present invention.

The third embodiment will be explained with reference to the flowchart of FIG. 11 together with FIGS. 7 and 8A to 8C used in the description of the second embodiment.

In step S401, a suction pump 7*c* is connected to a bubble discharge channel 1*j*. In step S402, a valve driving motor 8*b* rotates a cam 8*a* to lower the level position of a float push-down member 1*k* to the third position (position in FIG. 8C) and push down a float 1*g*. While the float push-down member 1*k* stays at the third position, the suction pump 7*c* operates to discharge bubbles to the bubble discharge channel 1*j* (recovery pump ON). At this time, the float push-down member 1*k* at the third position regulates movement of the float 1*g*, preventing press of the float 1*g* against a float sealing member 1*h* by discharged bubbles.

While the float push-down member 1*k* stays at the third position, the suction pump 7*c* operates for a predetermined time. After that, in step S403, the float push-down member 1*k* moves to an intermediate position to cancel the regulation of movement of the float 1*g*. Further, the suction pump 7*c* operates for a predetermined time (recovery pump ON), and stops in step S404 (recovery pump OFF). The float push-down member 1*k* moves to the uppermost position to close a float on-off valve 10 and set the state in FIG. 8A.

As described above, according to the third embodiment, while the float member is prevented from moving up to the float sealing member 1*h* owing to buoyant force or the like, the suction operation is executed in an initial stage of bubble removal, reliably removing bubbles and ink accumulated in advance in a float housing in. Thereafter, the float push-down member moves up to an intermediate position, and the recovery pump performs the bubble removal suction operation, removing bubbles in a sub-tank 1*a* and liquid chamber 1*c*.

(Fourth Embodiment)

The fourth embodiment more reliably removes bubbles by continuously executing a combination of the operations in the above-described first to third embodiments.

Figure 12:
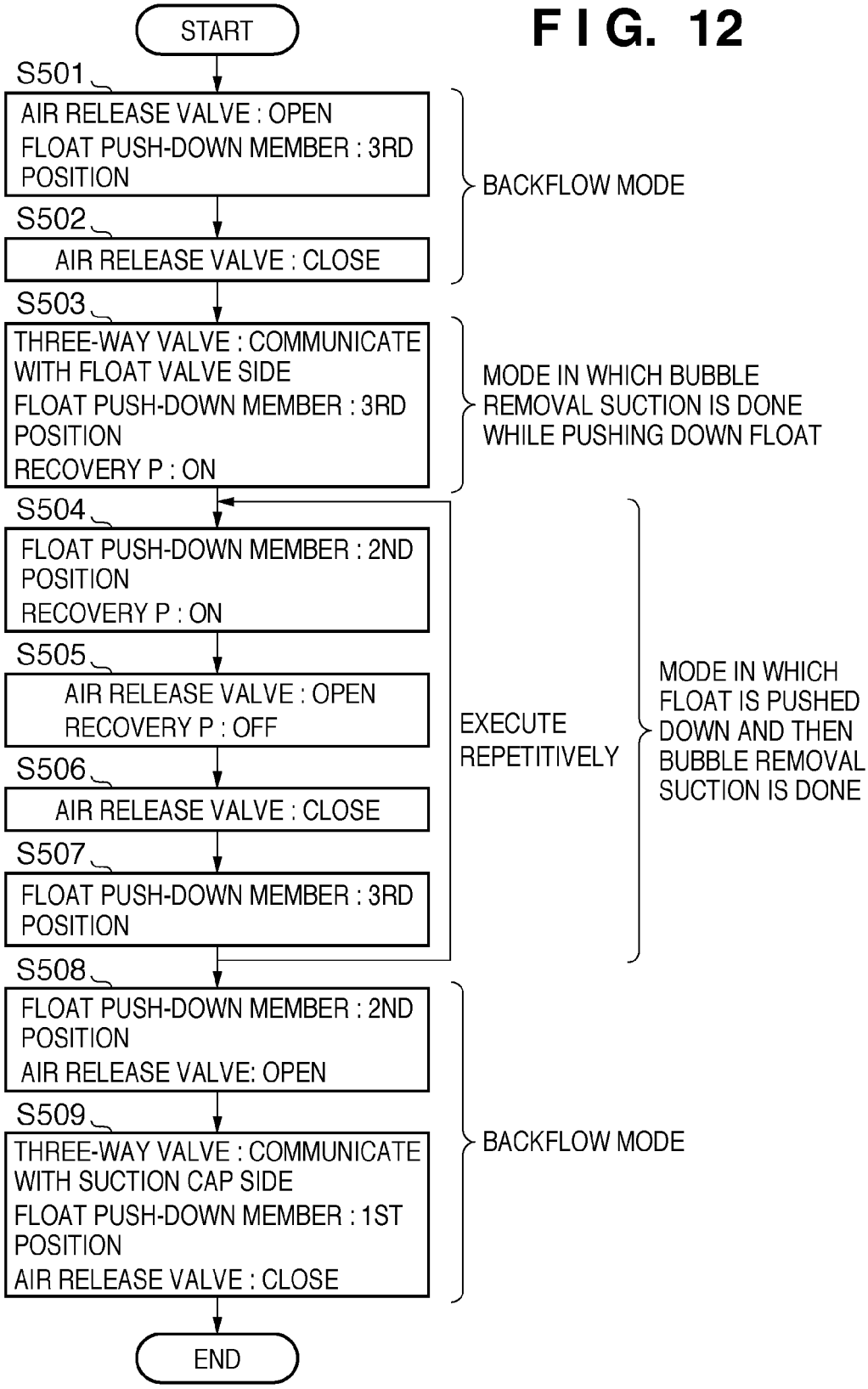
FIG. 12 is a flowchart showing a bubble removal sequence executed in the fourth embodiment of the present invention.

FIG. 12 is a flowchart showing bubble removal sequence procedures around a float valve in a liquid chamber 1*c* of a printhead. FIGS. 13A to 13I are sectional views showing the operation of the float valve and an outline of bubble removal when removing bubbles according to the sequence shown in FIG. 12. The fourth embodiment will be explained with reference to FIG. 7, and FIGS. 8A to 8C showing functions of a float valve with a float push-down mechanism at respective control positions, together with FIGS. 12 and 13A to 13I.

Figure 13A:
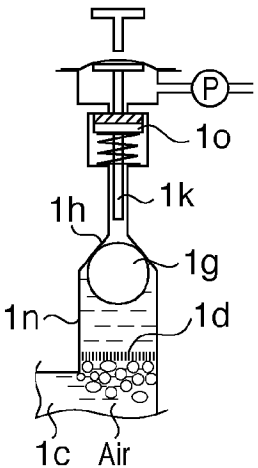
FIGS. 13A to 13I are sectional views showing bubble removal states at a float valve in the bubble removal sequence operation executed in the fourth embodiment of the present invention.

FIG. 13A shows a state before performing the bubble removal suction operation. In FIG. 13A, a predetermined amount or more of bubbles generated mainly by the printing operation is accumulated below an outlet filter 1*d* in the liquid chamber 1*c*. Ink is accumulated in a float housing 1*n* above the outlet filter 1*d*. A float 1*g* is pressed against a float sealing member 1*h* by buoyant force generated by the ink, sealing the float housing 1*n*.

In step S501 of FIG. 12, an air release valve 1*i* is opened under driving control of a valve driving unit 8, releasing the interior below the float valve to air, in order to make ink in the float housing 1*n* flow back to the liquid chamber 1*c*. A float push-down member 1*k* moves to the third position. After the air release valve 1*i* remains open for a predetermined time, it is closed in step S502. By releasing the interior below the float valve to air, ink below the float valve flows back into the liquid chamber 1*c* under a negative pressure always acting on ink in the printhead. The liquid level falls to the outlet filter 1*d*.

Figure 13B:
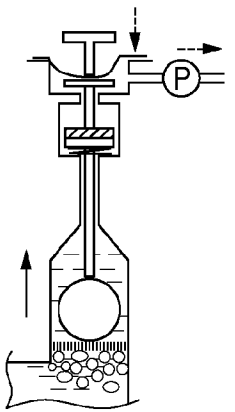

The ink backflow occurs when there is no bubble in the liquid chamber 1*c* below the outlet filter 1*d*. However, when a predetermined amount or more of bubbles is accumulated below the outlet filter 1*d*, bubbles obstruct ink backflow, and no ink may flow back. In step S503, to remove bubbles even in this case, the float push-down member moves to the third position shown in FIG. 8C to push down the float 1*g*, as shown in FIG. 13B. In this state, the suction pump rotates for a predetermined time (recovery pump ON).

In step S503, it is prevented to press the float against the float sealing member 1*h* by the buoyant force of ink accumulated around the float 1*g*, so as not to shut a bubble discharge channel 1*j*. While the float valve remains open, the bubble removal suction operation is done to discharge ink accumulated on the outlet filter 1*d*.

In the mode of step S503 in FIG. 12, a bubble removal operation failure by ink remaining on the outlet filter is avoided. The mode of S503 may also be omitted as long as it can be reliably assured that no ink exists on the outlet filter before the bubble removal sequence in the fourth embodiment.

Figure 13C:
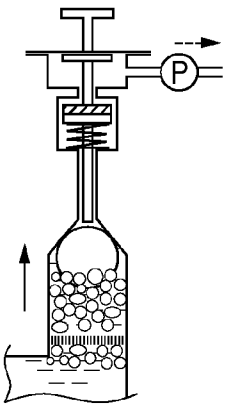

In step S504, while the suction pump rotates (recovery pump ON), the float push-down member 1*k* moves to the second position (FIG. 8B), as shown in FIG. 13C. Bubbles accumulated below the outlet filter 1*d* move into the float housing 1*n* through the outlet filter 1*d*, and push up the float 1*g* to shut the bubble discharge channel 1*j*.

Figure 13D:
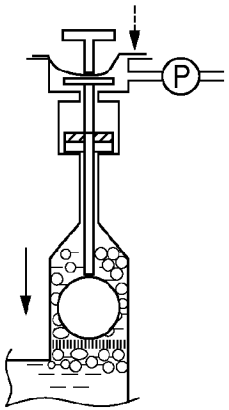

In step S505, the suction pump 7*c* temporarily stops (recovery pump OFF), and the air release valve 1*i* is opened to return the interior below the float valve to the atmospheric pressure. In step S506, the air release valve 1*i* is closed. In step S507, the float push-down member 1*k* moves to the third position (FIG. 8C) to push down the pushed-up float 1*g* again (FIG. 13D).

Figure 13E:
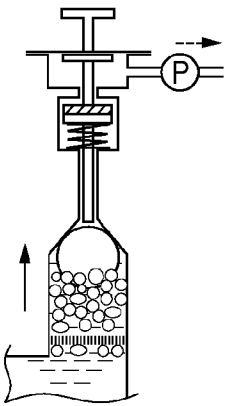
Figure 13F:
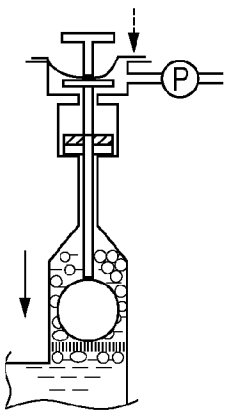
Figure 13G:
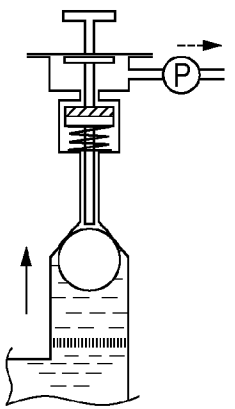

The process returns to S504 again to return the float push-down member to the second position, as shown in FIG. 13E, and the suction pump rotates for a predetermined time (step S505 in FIG. 12). And, in step S507 again, the float push-down member 1*k* moves to the third position to push down the pushed-up float 1*g* (FIG. 13F). Bubbles in the liquid chamber 1*c* can be removed again.

Figure 13H:
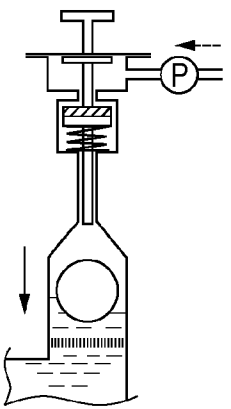
Figure 13I:
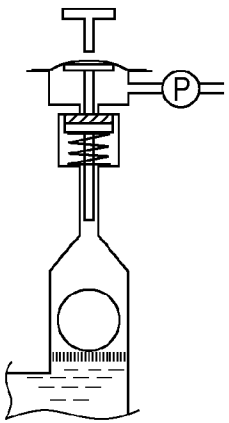
Figure 14:
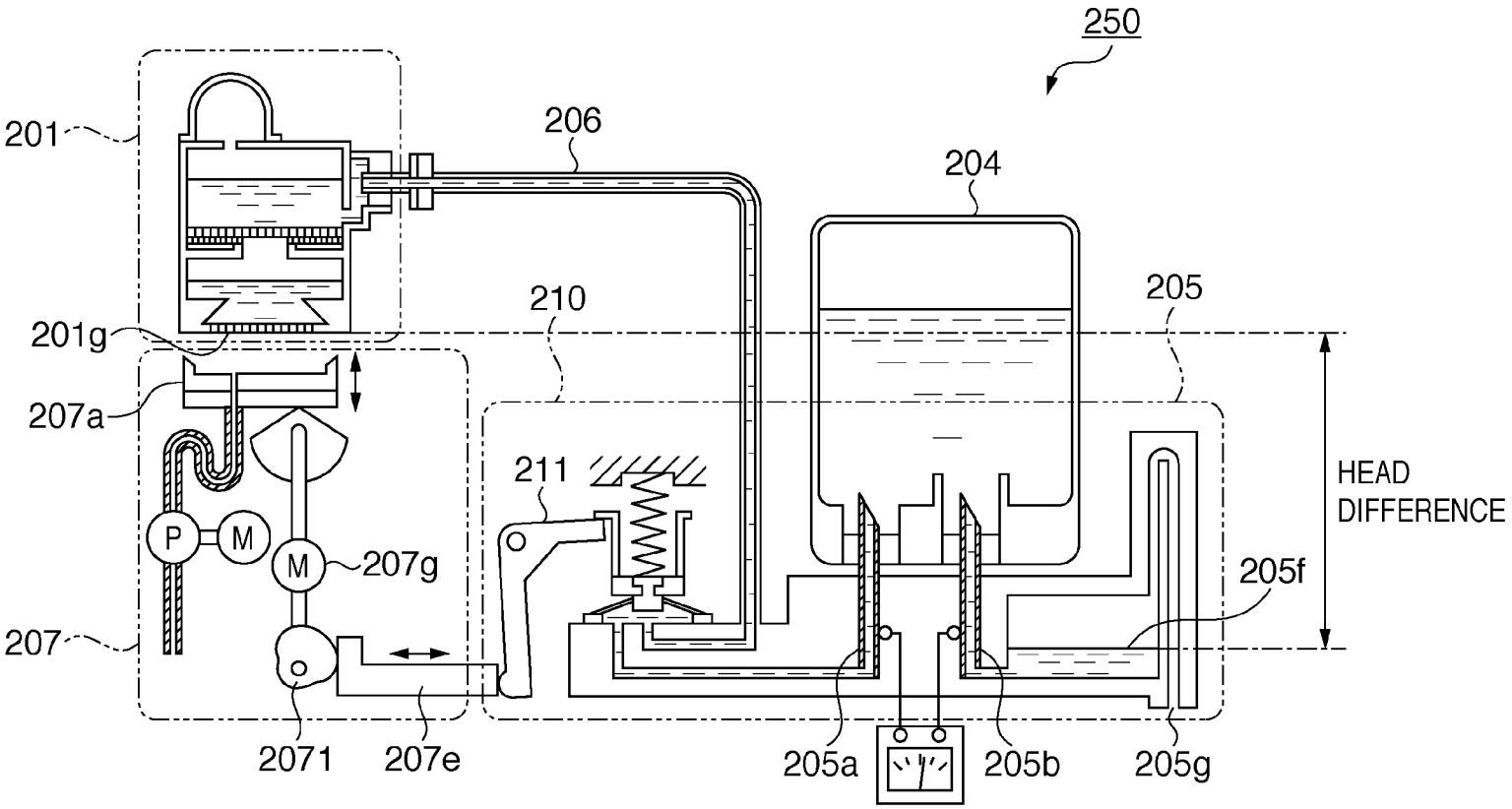
FIG. 14 is a sectional view showing the ink supply device of a conventional inkjet printing apparatus.
Figure 15:
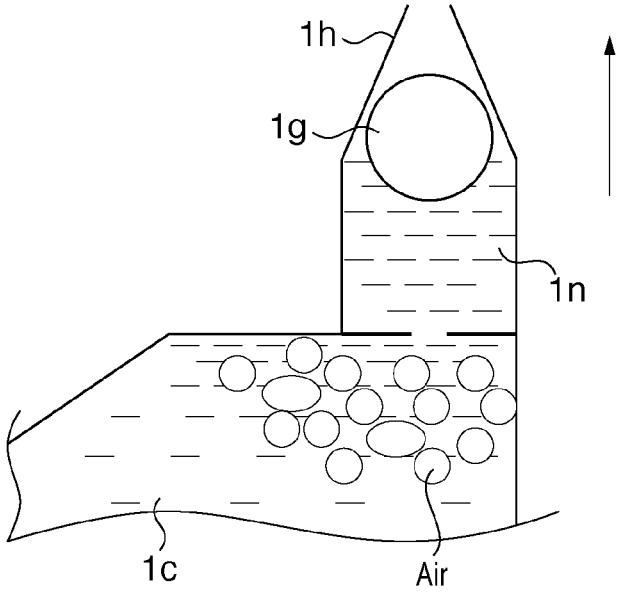
FIG. 15 is a sectional view of a float valve in removing bubbles when ink is accumulated around a float valve arranged in the conventional inkjet printing apparatus.
Figure 16A:
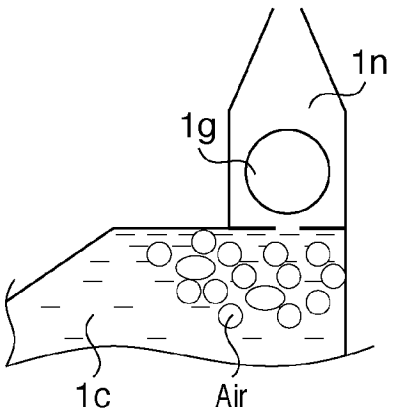
FIGS. 16A to 16C are sectional views of the float valve in removing bubbles when bubbles are accumulated around the float valve arranged in the conventional inkjet printing apparatus.
Figure 16B:
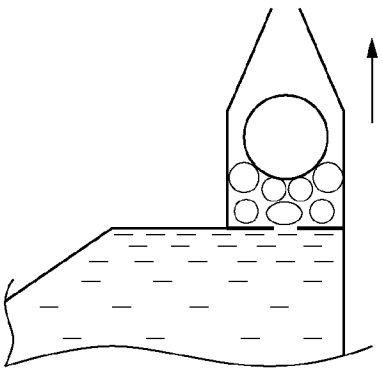
Figure 16C:
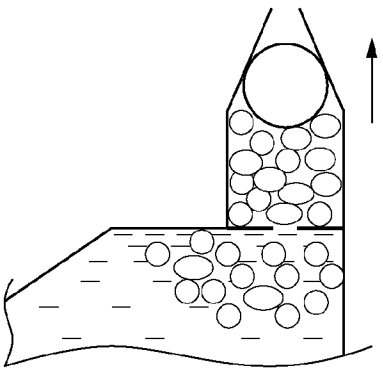

Bubbles in the liquid chamber 1*c* can be removed by repeating, a predetermined number of times, a series of operations of pushing down the float 1*g* and performing bubble removal suction by the suction pump. After that, in step S508, the float push-down member 1*k* moves to the second position (FIG. 13G) to make ink in the float housing 1*n* flow back to the liquid chamber 1*c* (FIG. 13H, backflow mode). In step S509, the float push-down member 1*k* moves to the uppermost position to close an air release valve 1*i* (FIG. 13I). In step S504, the float push-down member returns to the second position, and the suction pump is driven. Even if the liquid level of ink rises, the float 1*g* shuts the discharge channel to prevent ink from flowing to the discharge channel. By executing a series of bubble removal sequence operations according to the fourth embodiment, bubbles in the printhead can be reliably removed without wasting ink.

By repetitively performing the float push-down operation and bubble removal suction operation, the fourth embodiment can prevent a bubble removal operation failure caused by pushing down the float member by bubbles generated in ink.

Since ink in the float housing 1*n* is discharged by opening the air release valve for a predetermined time before bubble removal suction, a bubble removal operation failure caused by closing the float valve by the float member can be prevented.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-278963, filed Oct. 26, 2007 which is hereby incorporated by reference herein in its entirety.

The invention claimed is:

1. A discharging device comprising:

a liquid container configured to contain a liquid;

a discharge channel configured to discharge fluid from said liquid container;

a float member configured to movably exist in said discharge channel, and move up together with the liquid to come into contact with a float sealing member arranged in said discharge channel, thereby shutting said discharge channel, said float member being lower in specific gravity than the liquid;

separating means configured to separate said float member from the float sealing member;

suction means configured to discharge the fluid from said liquid container via said discharge channel; and control means configured to operate said separating means when operating said suction means.

2. The device according to claim 1, wherein said control means operates said suction means while operating said separating means to keep said float member spaced apart from the float sealing member.

3. The device according to claim 1, wherein said control means operates said suction means while operating said separating means to keep said float member spaced apart from the float sealing member, then controls said separating means not to act on said float member, and operates said suction means.

4. The device according to claim 1, wherein said separating means has a push-down member which abuts against said float member and pushes down said float member.

5. The device according to claim 1, wherein a filter is arranged upstream of the float sealing member in said discharge channel, and said float member is movable between the float sealing member and the filter.

6. The device according to claim 1, wherein said control means operates said suction means after operating said separating means.

7. The device according to claim 6, wherein said control means controls said separating means and said suction means to alternately repeat an operation of said separating means and an operation of said suction means in a state in which said separating means does not act on said float member.

8. The device according to claim 1, further comprising air release means configured to release said discharge channel to atmosphere when operating said separating means without operating said suction means.

9. The device according to claim 8, wherein said control means causes said air release means to release said discharge channel to atmosphere, closes said air release means, causes said separating means to separate said float member from the float sealing member, then controls said separating means not to act on said float member, and operates said suction means.

10. The device according to claim 9, wherein said control means controls to repeat an operation of causing said air release means to release said discharge channel to atmosphere, closing said air release means, causing said separating means to separate said float member from the float sealing member, then controlling said separating means not to act on said float member, operating said suction means, and stopping said suction means.

11. A printing apparatus comprising:

an orifice configured to discharge a liquid to print on a print medium;

a liquid container configured to contain the liquid to be supplied to the orifice;

a discharge channel configured to discharge fluid from said liquid container;

a float member configured to movably exist in said discharge channel, and move up together with the liquid to come into contact with a float sealing member arranged in said discharge channel, thereby shutting said discharge channel, said float member being lower in specific gravity than the liquid;

separating means configured to separate said float member from the float sealing member;

suction means configured to discharge the fluid from said liquid container via said discharge channel; and control means configured to operate said separating means when operating said suction means.

12. The apparatus according to claim 11, wherein said control means operates said suction means while operating said separating means to keep said float member spaced apart from the float sealing member.

13. The apparatus according to claim 11, wherein said control means operates said suction means after operating said separating means.

* * * * *